US011814595B1

(12) United States Patent
Lopez Pintor et al.

(10) Patent No.: US 11,814,595 B1
(45) Date of Patent: Nov. 14, 2023

(54) ADDITIVES FOR IMPROVING AUTOIGNITION REACTIVITY OF HYDROCARBON-BASED FUELS

(71) Applicant: National Technology & Engineering Solutions of Sandia, LLC, Albuquerque, NM (US)

(72) Inventors: Dario Lopez Pintor, Livermore, CA (US); John E. Dec, Livermore, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 17/973,172

(22) Filed: Oct. 25, 2022

(51) Int. Cl.

| | |
|---|---|
| ***C10L 1/06*** | (2006.01) |
| ***C10L 1/08*** | (2006.01) |
| ***C10L 1/23*** | (2006.01) |

(52) U.S. Cl.
CPC ..... *C10L 1/231* (2013.01); *C10L 1/06* (2013.01); *C10L 1/08* (2013.01); *C10L 2200/0259* (2013.01); *C10L 2270/023* (2013.01); *C10L 2270/026* (2013.01)

(58) Field of Classification Search
CPC .... C10L 1/231; C10L 1/06; C10L 1/08; C10L 2200/0259; C10L 2270/023; C10L 2270/026
See application file for complete search history.

(56) References Cited

U.S. PATENT DOCUMENTS

2008/0098645 A1* 5/2008 Renninger ..... C12P 5/007 44/388

OTHER PUBLICATIONS

Cheng, et al., "Autoignition and preliminary heat release of gasoline surrogates and their blends with ethanol at engine-relevant conditions: Experiments and comprehensive kinetic modeling," Combustion and Flame 228 (2021) 57-77, doi:10.1016/j.combustflame.2021.01.033 (published Feb. 26, 2021).
Cho, et al., "Understanding the effects of doping a regular E10 gasoline with EHN in an HCCI engine: Experimental and numerical study," Fuel 329 (2022) 125456, doi:10.1016/j.fuel.2022.125456 (published Aug. 4, 2022).
Cho, et al., "Chemical kinetic interactions and sensitivity analyses for 2-ethylhexyl nitrate-doped PRF91 using a reduced mechanism," Fuel 329 (2022) 125503, doi:10.1016/j.fuel.2022.125503 (published Aug. 6, 2022).

(Continued)

*Primary Examiner* — Ellen M McAvoy
*Assistant Examiner* — Chantel Graham
(74) *Attorney, Agent, or Firm* — Samantha Updegraff; Calfee, Halter & Griswold LLP

(57) ABSTRACT

According to various aspects, an additive for a hydrocarbon-based fuel has a formula (I), in which $R_1$, $R_2$, and $R_3$ are each independently selected from —H, —$CH_3$, or —$CH_2CH_3$, and at least one of $R_1$, $R_2$, or $R_3$ is not —H. The additive improves an autoignition reactivity of the hydrocarbon-based fuel. The additive can be present in the fuel composition including the additive and the hydrocarbon-based fuel in an amount of 0.1% by volume to 5% by volume. The hydrocarbon-based fuel can comprise gasoline or diesel.

20 Claims, 5 Drawing Sheets

(56) References Cited

OTHER PUBLICATIONS

Lopez-Pintor, et al., "Development and Validation of an EHN Mechanism for Fundamental and Applied Chemistry Studies," SAE Technical Paper, 2022-01-0455, 2022, doi: 10.4271/2022-01-0455 (published Mar. 29, 2022), 19 pages.
Lopez-Pintor, et al,. "Experimental Evaluation of a Gasoline-like Fuel Blend with High Renewable Content to Simultaneously Increase φ-Sensitivity, RON, and Octane Sensitivity" Energy Fuels 2021, 35, 20, 16482-16493, DOI: 10.1021/acs.energyfuels.1c01979 (published Oct. 7, 2021).
Lopez-Pintor, et al., "Experimental Evaluation of a Custom Gasoline-Like Blend Designed to Simultaneously Improve ϕ-Sensitivity, RON and Octane Sensitivity," SAE Int. J. Adv. & Curr. Prac. in Mobility 2(4):2196-2216, 2020, https://doi.org/10.4271/2020-01-1136 (published Apr. 14, 2020).
Lopez-Pintor, et al., "Φ-Sensitivity for LTGC Engines: Understanding the Fundamentals and Tailoring Fuel Blends to Maximize This Property," SAE Technical Paper 2019-01-0961, 2019, https://doi.org/10.4271/2019-01-0961 (published Apr. 2, 2019), 24 pages.
"Amyl nitrate," Wikipedia, en.wikipedia.org/wiki/Amyl_nitrate, accessed Aug. 29, 2022, 3 pages.

* cited by examiner

ADDITIVES FOR IMPROVING AUTOIGNITION REACTIVITY OF HYDROCARBON-BASED FUELS

STATEMENT OF GOVERNMENTAL INTEREST

This invention was made with Government support under Contract No. DE-NA0003525 awarded by the United States Department of Energy/National Nuclear Security Administration. The U.S. Government has certain rights in the invention.

BACKGROUND

Fuel chemistry can be designed to enhance engine performance, fuel stability, and octane and cetane rating. For example, additives can be included in fuel compositions to provide such beneficial properties. However, the identification of such additives and their properties remains a challenge. Accordingly, there remains a need for alternative fuel additives and fuel compositions including the same.

SUMMARY

The following is a brief summary of subject matter that is described in greater detail herein. This summary is not intended to be limiting as to the scope of the claims.

According to a first aspect of the present disclosure, an additive for a hydrocarbon-based fuel has a formula of:

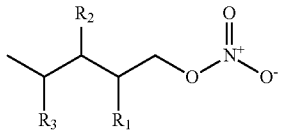

$R_1$, $R_2$, and $R_3$ are each independently selected from —H, —$CH_3$, or —$CH_2CH_3$, and at least one of $R_1$, $R_2$, or $R_3$ is not —H. The additive improves an autoignition reactivity of the hydrocarbon-based fuel.

In some aspects, $R_1$ and $R_3$ are —$CH_3$, and $R_2$ is —H. In some aspects, $R_1$ is —$CH_2CH_3$, $R_2$ is —H, and $R_3$ is —$CH_3$. In some aspects, $R_1$ and $R_3$ are —H, and $R_2$ is —$CH_3$.

In some aspects, the hydrocarbon-based fuel comprises gasoline. In some aspects, the hydrocarbon-based fuel comprises diesel.

According to aspects of the present disclosure, a fuel composition comprises a hydrocarbon-based fuel and an additive having a formula of:

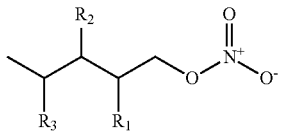

$R_1$, $R_2$, and $R_3$ are each independently selected from —H, —$CH_3$, or —$CH_2CH_3$, and at least one of $R_1$, $R_2$, or $R_3$ is not —H.

In some aspects, the additive is present in the fuel composition in an amount of 0.1% by volume to 5% by volume. In some aspects, $R_1$ and $R_3$ are —$CH_3$, and $R_2$ is —H. In some aspects, $R_1$ is —$CH_2CH_3$, $R_2$ is —H, and $R_3$ is —$CH_3$. In some aspects, $R_1$ and $R_3$ are —H, and $R_2$ is —$CH_3$.

In some aspects, the hydrocarbon-based fuel comprises gasoline. In some aspects, the hydrocarbon-based fuel comprises diesel.

According to various aspects, a method of improving the autoignition reactivity of a hydrocarbon-based fuel composition comprises mixing an additive with the hydrocarbon-based fuel, the additive having a formula of:

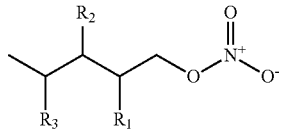

$R_1$, $R_2$, and $R_3$ are each independently selected from —H, —$CH_2CH_3$, or —$CH_3$, and at least one of $R_1$, $R_2$, or $R_3$ is not —H.

In some aspects, an amount of additive mixed with the hydrocarbon-based fuel is from 0.1% by volume to 5% by volume.

In some aspects, $R_1$ and $R_3$ are —$CH_3$, and $R_2$ is —H. In some aspects, $R_1$ is —$CH_2CH_3$, $R_2$ is —H, and $R_3$ is —$CH_3$. In some aspects, $R_1$ and $R_3$ are —H, and $R_2$ is —$CH_3$.

According to some aspects, the hydrocarbon-based fuel comprises gasoline. In some aspects, the hydrocarbon-based fuel comprises diesel.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
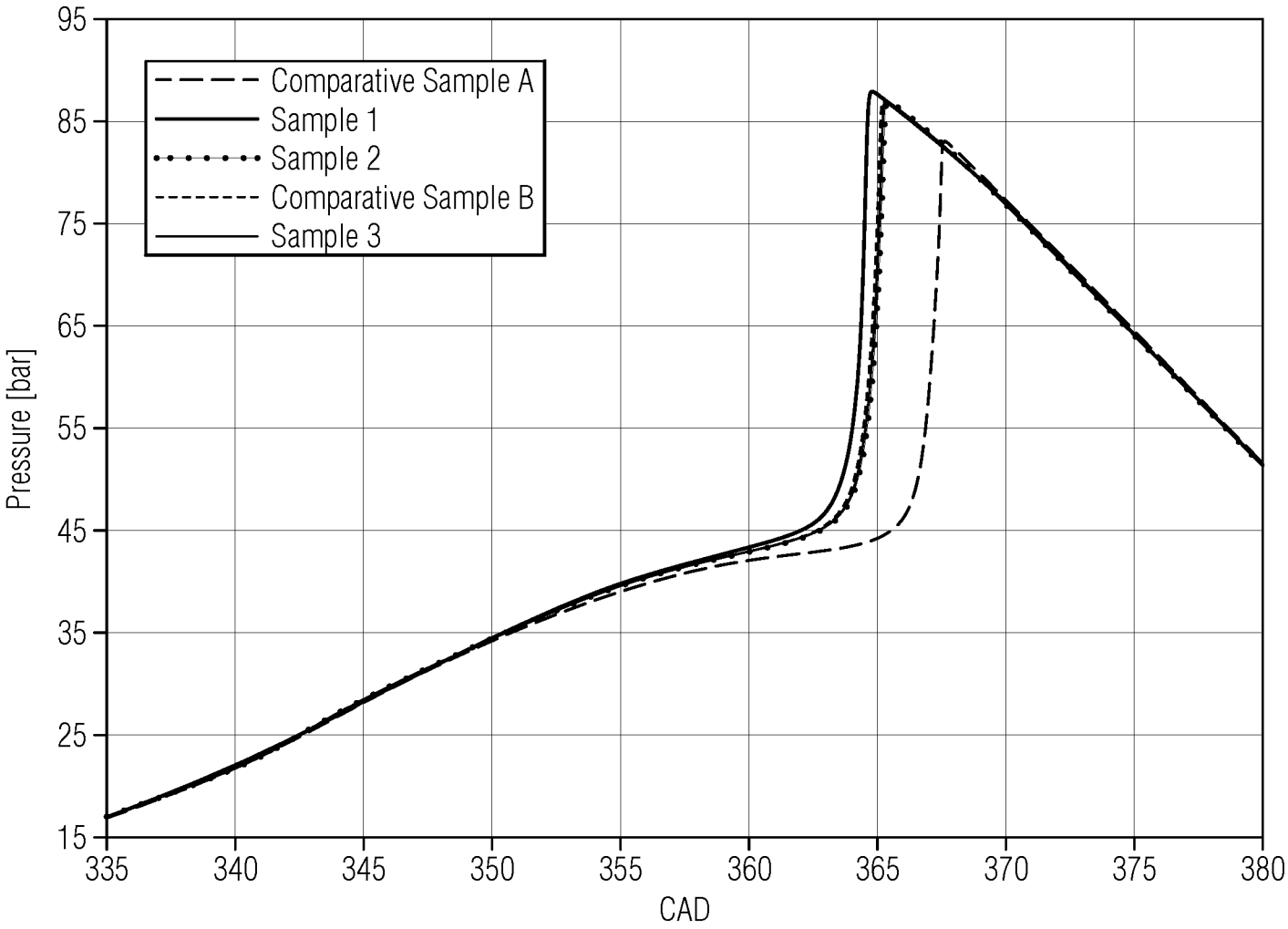
FIG. 1 is a graph of the simulated cylinder pressure (in bar; Y-axis) as a function of crank angle (CAD; X-axis) for samples including 1% by volume of an alkyl nitrate additive as described in the Examples.

Various technologies pertaining to fuel additives and fuel compositions including the same are now described with reference to the drawings.

In various aspects of the present disclosure, a fuel composition includes an alkyl nitrate additive that is effective to improve the autoignition reactivity of the base fuel (e.g., the hydrocarbon-based fuel). Additionally, in some aspects, the alkyl nitrate additive exhibits greater efficacy than conventional reactivity improving additives (such as 2-ethylhexyl nitrate or EHN), thereby enabling a reduction in the amount of additive needed to achieve a desired cetane number (CN) or research octane number (RON). In some aspects, the alkyl nitrate additive can also lead to less engine nitrogen oxide (NOx) emissions as compared to fuel compositions containing conventional reactivity improving additives.

Alkyl Nitrate Additives

The alkyl nitrate additives of the present disclosure enhance autoignition in fuel compositions. Accordingly, the fuel composition of the present disclosure can include one or more alkyl nitrate additives. In various aspects, the alkyl nitrate additive includes a substituted $C_5$ alkyl nitrate. The substituted $C_5$ alkyl nitrate generally has the following formula (I):

(I)

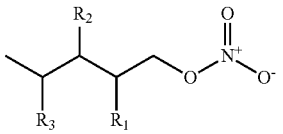

where $R_1$, $R_2$, and $R_3$ are each independently selected from —H, —$CH_3$, or —$CH_2CH_3$, and at least one of $R_1$, $R_2$, and $R_3$ is not —H. In some aspects, in formula (I), $R_1$ and $R_3$ are —$CH_3$, and $R_2$ is —H, such that the substituted $C_5$ alkyl nitrate is 2,4 dimethyl pentyl nitrate and has the following formula (II):

(II)

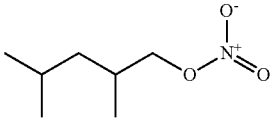

In some aspects, in formula (I), $R_1$ is —$CH_2CH_3$, $R_2$ is —H, and $R_3$ is —$CH_3$, such that the substituted $C_5$ alkyl nitrate is 2-ethyl, 4-methyl pentyl nitrate and has the following formula (III):

(III)

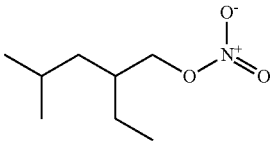

In some aspects, in formula (I), $R_1$ and $R_3$ are —H and $R_2$ is —$CH_3$, such that the substituted $C_5$ alkyl nitrate is 3-methyl pentyl nitrate and has the following formula (IV):

(IV)

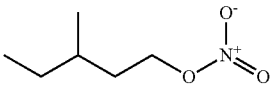

Resistance to autoignition is quantified by the octane rating, with Research Octane Number (RON) and Motor Octane Number (MON) ASTM tests having long been used as the two metrics to quantify a fuel's octane or antiknock performance. Accordingly, in various aspects, the substituted $C_5$ alkyl nitrate additive is present in an amount such that a RON of the fuel composition including the substituted $C_5$ alkyl nitrate additive is lower than the individual RON of the base fuel. RON can be determined, for example, using standard test methods, e.g., ASTM D2699-16 and ASTM D2699-18. In some aspects, the base fuel is a gasoline having a RON between about 70 and about 120, or between about 92 and about 98.

Autoignition propensity can be measured by the cetane number (CN). The CN of a fuel is also used to characterize the suitability of a fuel for conventional diesel engines. The Environmental Protection Agency (EPA) establishes a minimum CN of 40 for diesel fuel in the U.S., but regular diesel generally has a CN of between about 42 and about 45, and premium diesel generally has a CN of between about 47 and about 50. However, straight diesel fuel may not accomplish the CN requirements. For example, catalytic cracking of heavy distillation cuts of crude oil, which represent from about 20% to about 80% of the total distilled crude oil, produces fuel having a CN below 40.

Accordingly, in various aspects, the substituted $C_5$ alkyl nitrate additive is present in an amount such that a CN of the fuel mixture is greater than the individual CN of the base fuel. This can allow diesel fuel to meet the legal requirements or to be upgraded from regular diesel to premium diesel. CN is determined using the standard test method ASTM D613. Derived Cetane Number (DCN), which is an alternative metric that is easier to measure and generally considered to be more representative of engine conditions, can be determined by Ignition Quality Test (IQT) according to ASTM D6890 protocol (ASTM-D6890-16e1, 2016), and No-Flow Point according to ASTM D7346 protocol (ASTM-D7346-15, 2015). In some aspects, the base fuel is a diesel fuel having a DCN between about 20 and about 75, or between about 40 and about 55.

The substituted $C_5$ alkyl nitrate additive is present in the fuel composition in an amount of less than or equal to about 5% by volume (v/v), less than or equal to about 4% by volume, less than or equal to about 3% by volume, less than or equal to about 2% by volume, or even less than or equal to about 1% by volume. For example, the substituted $C_5$ alkyl nitrate additive can be included in the fuel composition in an amount of from about 0.1% by volume to about 5% by volume, from about 0.1% by volume to about 4.5% by volume, from about 0.1% by volume to about 4% by volume, from about 0.1% by volume to about 3.5% by volume, from about 0.1% by volume to about 3% by volume, from about 0.1% by volume to about 2.5% by volume, from about 0.1% by volume to about 2% by volume, from about 0.1% by volume to about 1.5% by volume, from about 0.1% by volume to about 1% by volume, from about 0.5% by volume to about 5% by volume, from about 0.5% by volume to about 4.5% by volume, from about 0.5% by volume to about 4% by volume, from about 0.5% by volume to about 3.5% by volume, from about 0.5% by volume to about 3% by volume, from about 0.5% by volume to about 2.5% by volume, from about 0.5% by volume to about 2% by volume, from about 0.5% by volume to about 1.5% by volume, from about 1% by volume to about 5% by volume, from about 1% by volume to about 4.5% by volume, from about 1% by volume to about 4% by volume, from about 1% by volume to about 3.5% by volume, from about 1% by volume to about 3% by volume, from about 1% by volume to about 2.5% by volume, from about 1% by volume to about 2% by volume, from about 1% by volume to about 1.5% by volume, from about 1.5% by volume to about 5% by volume, from about 1.5% by volume to about 4.5% by volume, from about 1.5% by volume to about 4% by volume, from about 1.5% by volume to about 3.5% by volume, from about 1.5% by volume to about 3% by volume, from about 1.5% by volume to about 2.5% by volume, or from about 1.5% by volume to about 2% by volume, including any and all ranges and sub-ranges therein.

According to various aspects of the present disclosure, the alkyl nitrate additive (e.g., the substituted $C_5$ alkyl nitrate additive) can be prepared generally by nitration of alcohols which are combined with nitric acid to obtain the desired alkyl nitrate in water in a process in which an acid (e.g., sulfuric acid) is used as a catalyst. This reaction process is typically referred to as nitroxylation, and can be described by the following reaction:

$$\text{Alcohol}+HNO_3+H_2SO_4 \rightarrow \text{Alkyl nitrate}+H_2O+H_2SO_4$$

In particular, the sulfuric acid produces protonated nitric acid species that are attacked by the alcohol. The oxygen atom of the alcohol is attached to the nitro group, producing an alkyl nitrate and water. Finally, the alkyl nitrate condensate is obtained by a water-separation method.

Complex alcohols for the production of alkyl nitrates are typically generated by hydrogenation of the corresponding aldehyde, using nickel, palladium, or platinum as a catalyst according to the following reaction:

$$\text{Aldehyde}+H_2 \rightarrow \text{Alcohol}$$

The corresponding aldehydes can be generated from methane and propane, which are combined with CO and $H_2$ to generate propanal and methyl propanal species. These propanals are later combined by chemical condensation to obtain long aldehydes and water (using an acid as a catalyst).

As described above, in various aspects of the present disclosure, the substituted $C_5$ alkyl nitrate comprises 2,4 dimethyl pentyl nitrate, 2-ethyl, 4-methyl pentyl nitrate, and/or 3-methyl pentyl nitrate. The corresponding alcohols and aldehydes to prepare these substituted $C_5$ alkyl nitrates are provided in Table 1 below:

TABLE 1

| Alkyl Nitrate | Alcohol | Aldehyde |
|---|---|---|
| 2,4 dimethyl pentyl nitrate | 2,4 dimethyl pentanol | 2,4 dimethyl pentanal |
| 2-ethyl, 4-methyl pentyl nitrate | 2-ethyl, 4-methyl pentanol | 2-ethyl, 4-methyl pentanal |
| 3-methyl pentyl nitrate | 3-methyl pentanol | 3-methyl pentanal |

In various aspects, the substituted $C_5$ alkyl nitrate additive is blended into a hydrocarbon-based fuel (e.g., a base fuel), thereby providing a fuel composition including the substituted $C_5$ alkyl nitrate additive. Accordingly, as used herein, the term "base fuel" refers to a fuel that does not include the substituted $C_5$ alkyl nitrate additive and the terms "fuel composition" and "fuel mixture" refers to a fuel including the substituted $C_5$ alkyl nitrate additive unless otherwise specified. Such blending can occur by volume and/or weight of the solute, solvent, and/or solution.

As described above, in various aspects of the present disclosure, the substituted $C_5$ alkyl nitrate additive improves the autoignition reactivity of the base fuel (e.g., the hydrocarbon-based fuel). In various aspects, the substituted $C_5$ alkyl nitrate additive exhibits greater efficacy than conventional reactivity improving additives (such as 2-ethylhexyl nitrate or EHN), thereby enabling a reduction in the amount of additive needed to achieve a specific CN or RON. For example, a concentration of substituted $C_5$ alkyl nitrate additive required to match the combustion phasing of an otherwise identical gasoline fuel composition including EHN instead of the substituted $C_5$ alkyl nitrate additive can be reduced by 20% or more, 22% or more, 24% or more, 26% or more, 28% or more, or even 30% or more as compared to the concentration of EHN. In some aspects, a concentration of substituted $C_5$ alkyl nitrate additive required to match the combustion phasing of an otherwise identical gasoline fuel composition including EHN instead of the substituted $C_5$ alkyl nitrate additive can be reduced by from 20% to 40%, from 20% to 35%, from 20% to 32%, from 20% to 31%, from 22% to 40%, from 22% to 35%, from 22% to 32%, from 22% to 31%, from 24% to 40%, from 24% to 35%, from 24% to 32%, or from 24% to 31%, including any and all ranges and sub-ranges therein, as compared to the concentration of EHN.

In some aspects, a concentration of substituted $C_5$ alkyl nitrate additive required to match the ignition delay of an otherwise identical diesel fuel composition including EHN instead of the substituted $C_5$ alkyl nitrate additive can be reduced by 40% or more, 45% or more, 50% or more, 55% or more, 60% or more, 65% or more, or even 70% or more as compared to the concentration of EHN. In some aspects, a concentration of substituted $C_5$ alkyl nitrate additive required to match the ignition delay of an otherwise identical diesel fuel composition including EHN instead of the substituted $C_5$ alkyl nitrate additive can be reduced by from 40% to 90%, from 40% to 85%, from 40% to 80%, from 40% to 75%, from 45% to 90%, from 45% to 85%, from 45% to 80%, from 45% to 75%, from 50% to 90%, from 50% to 85%, from 50% to 80%, from 50% to 75%, from 55% to 90%, from 55% to 85%, from 55% to 80%, from 55% to 75%, from 60% to 90%, from 60% to 85%, from 60% to 80%, from 60% to 75%, from 65% to 90%, from 65% to 85%, from 65% to 80%, or from 65% to 75%, including any and all ranges and sub-ranges therein, as compared to the concentration of EHN.

In some aspects, the substituted $C_5$ alkyl nitrate additive can also lead to less engine nitrogen oxide (NOx) emissions as compared to fuel compositions containing conventional reactivity improving additives. For example, an amount of NOx emissions contributed by the substituted $C_5$ alkyl nitrate additive to the engine NOx can be reduced by 8% or more, 10% or more, 12% or more, 15% or more, 17% or more, 20% or more, or even 24% or more, as compared to an amount of NOx emissions contributed by EHN for the same combustion phasing. In some aspects, an amount of NOx emissions contributed by the substituted $C_5$ alkyl nitrate additive to the engine NOx can be reduced by from 8% to 30%, from 10% to 30%, from 8% to 25%, or from 10% to 25%, including any and all ranges and sub-ranges therein.

For example, according to some aspects, higher thermal efficiencies may be obtained compared to the most common control method currently used for low-temperature gasoline combustion (LTGC) engines, which involves using retained hot residuals to induce autoignition. Besides potentially eliminating the need to revert to spark-ignition (SI) combustion at high loads, which could allow a higher compression ratio to be used, resulting in higher efficiencies, using the substituted $C_5$ alkyl nitrate additive can also increase efficiencies by reducing combustion temperatures at lower boost conditions and eliminating the need for hot residuals. Even with the higher compression ratios possible when SI combustion for high loads is not required, for naturally aspirated and low-boost operation, current LTGC engines require significant intake heating or a significant amount of hot residuals to be mixed with the fresh reactants to achieve autoignition because of the low autoignition reactivity of gasoline, which results in higher combustion temperatures. However, with the application of an autoignition-enhancing fuel additive, as in the present disclosure, autoignition can be achieved with little or no heating, resulting in lower combustion temperatures. This increases the efficiency because lower temperatures result in a higher gamma (specific-heat ratio, $\gamma=cp/cv$), which means that more work is extracted during the expansion stroke. Furthermore, gamma is also higher because there is no need for retained hot residuals, which have a low gamma due to the tri-atomic molecules in the combustion-product gases ($CO_2$ and $H_2O$). Finally, with lower charge-gas temperatures, heat transfer losses are likely to be less.

Moreover, with lower autoignition temperatures, the combustion temperatures can be kept well below those that form thermal NOx. Although some NOx is produced by the combustion of one of the commonly used ignition improvers, 2-ethylhexyl nitrate, amounts are well below those requiring after-treatment.

Base Fuel Composition

The base fuels of the present disclosure can be a neat hydrocarbon-based fuel or a blended hydrocarbon-based fuel. Such blended fuels can include two or more chemical components. In this context, any chemical component useful in fuel can be present within the fuel or fuel mixture. In particular aspects of the present disclosure, the fuel mixture includes one or more chemical components (or blendstocks) in combination with the substituted $C_5$ alkyl nitrate additive of the present disclosure. In some aspects, the fuel or fuel mixture includes one or more components that are volatile and suitable for use in spark ignition engines and/or advanced compression ignition engines.

Chemical components that can be used in accordance with fuels and fuel mixtures of the present disclosure include, but are not limited to, an alkylate (e.g., isoparaffin), a paraffin (e.g., normal paraffins, iso-paraffins), an olefin (e.g., butylene, such as di-isobutylene, and a pentene (e.g., 2,4,4-trimethyl-1-pentene and/or 2,4,4-trimethyl-2-pentene)), a reformate (e.g., aromatics), a naptha (e.g., n-, iso-, cycloparaffin), a naphthene (e.g., cycloparaffins), a ketone (e.g., butanone (e.g., 3-methyl-2-butanone), pentanone (e.g., 2-pentanone, 3-pentanone, 4-methyl-2-pentanone, 2,4-dimethyl-3-pentanone, and cyclopentanone), hexanone, a cyclic ketone (e.g., cyclopentanone) or a ketone mixture), an aromatic (e.g., single ring and multi-ring aromatics, such as toluene), an alcohol (e.g., methanol, ethanol, propanol (e.g., 1-propanol and iso-propanol), butanol (e.g., 1-butanol, 2-butanol, iso-butanol, and 2-methylbutan-1-ol), and pentanol (e.g., 2-pentanol)), an alkene (e.g., a butylene (e.g., such as di-isobutylene), hexene (e.g., 1-hexene), etc.), an alkane (e.g., a branched alkane, such as 2,2,3-trimethylbutane; and butane (e.g., n-butane), pentane, heptane (e.g., n-heptane), octane (e.g., iso-octane), etc.), a fatty acid (including esters thereof, e.g., simple fatty acid esters and/or volatile fatty acid esters), a fatty ester, a furan (e.g., 2,5-dimethylfuran, 2-methylfuran, and combinations thereof), an ether (e.g., anisole), an ester (e.g., an acetate (e.g., methyl acetate, ethyl acetate, iso-propyl acetate, butyl acetate, 2-methylpropyl acetate, and 3-methylpropyl acetate), a butanoate (e.g., methyl butanoate, methyl isobutanoate, methyl-2-methylbutanoate, ethyl butanoate, and ethyl isobutanoate), a pentanoate (e.g., methyl pentanoate), and mixed esters), an oxygenate (e.g., an alcohol including a polyol, such as propanol (e.g., 1- or 2-propanol), ethanol, butanol (e.g., 1- or 2-butanol), diol (e.g., 1,3-propanediol and 2,3-butanediol), triol (e.g., glycerol); or a carboxylic acid (e.g., acetic acid)), an aldehyde (e.g., prenal), a carboxylic acid, a multicomponent mixture (e.g., methanol-to-gasoline, ethanol-to-gasoline, bioreformate via multistage pyrolysis, bioreformate via catalytic conversion of sugar, mixed aromatics via catalytic fast pyrolysis, and aromatics and olefins via pyrolysis-derived sugars), as well as combinations and/or isomers of any of these. Each of these chemical components can be present in the base fuel, as well as employed as a blending component with other oxygenate(s) and/or fuel(s) to provide a finished fuel product having desired fuel standards.

Exemplary base fuels and base fuel mixtures also include conventional gasoline, oxygenated gasoline, reformulated gasoline, biofuel (e.g., a fuel derived from a biomass containing biological material, such as those including plants, plant-derived materials, bacteria, fungi, and/or algae), biogasoline, biodiesel, bioblendstock (including component(s) produced from biomass, e.g., components such as cellulosic ethanol, methanol, butanol, triptane-rich blend, mixed aromatics, mixed ketones, an iso-olefin mixture, etc.), Fischer-Tropsch gasoline, petroleum blendstock, blendstock for oxygenate blending (BOB), reformulated blendstock for oxygenated blending (RBOB), conventional blendstock for oxygenate blending (CBOB), premium blendstock for oxygenate blending (PBOB), CARBOB (an RBOB suitable for use in California as regulated by the California Air Resources Board), gasoline treated as blendstock (GTAB), crude oil, fuel oil, distillate fuel oil, diesel fuel, jet fuel, petroleum, a natural gas liquid (e.g., any isomer and combination of methane, ethane, propane, butane, pentane, hexane, heptane, as well as higher molecular weight hydrocarbons, and mixtures thereof), a hydrocarbon (e.g., any described herein), a surrogate fuel (e.g., octane (e.g., iso-octane), toluene, heptane, or hexene (e.g., 1-hexene)), a core fuel (e.g., alkylate, E30 (a blend of 30% ethanol in fuel component(s)), aromatics, cycloparaffins, and olefins), and combinations thereof.

In some aspects of the present disclosure, the base fuel includes a surrogate fuel. An exemplary surrogate fuel (e.g., surrogate gasoline) can include octane (e.g., iso-octane) and heptane (e.g., n-heptane). Another exemplary surrogate fuel (e.g., surrogate gasoline) can include octane (e.g., iso-octane), heptane (e.g., n-heptane), toluene, and hexene (e.g., 1-hexene) (e.g., iso-octane (55 vol %), n-heptane (15 vol %), toluene (25 vol %), and 1-hexene (5 vol %)). Yet another exemplary surrogate fuel (e.g., surrogate jet fuel) can include decane, dodecane, methylcyclohexane, and toluene. Another exemplary surrogate fuel (e.g., surrogate diesel) can include hexadecane. Another exemplary surrogate fuel (e.g., surrogate biodiesel) can include methyl butyrate and methyl decanoate.

In aspects, the base fuel includes component(s) obtained from processing a biomass (e.g., oil crops, algae, yeast, bacteria, etc.). Exemplary components from such biomass can include alcohols, aldehydes, aromatics, carboxylic acids, cyclic fatty acids, esters, ethers, fatty acid esters, furanics, isoprenoids, ketones, naphthenics, olefins, polyketides, terpenes, etc.

Fuels and fuel mixtures, including blendstocks, optionally may include other chemicals and additives to adjust properties of the fuel and/or to facilitate fuel preparation. Examples of such chemicals or additives include detergents, antioxidants, stability enhancers, demulsifiers, corrosion inhibitors, metal deactivators, antiknock additives, valve seat recession protectant compounds, dyes, diluents, friction modifiers, markers, solvents, carrier solutions (e.g., mineral oil, alcohols, carboxylic acids, synthetic oils, etc.), etc. More than one additive or chemical can be used.

The general inventive concepts have been described above both generally and with regard to various specific aspects. Although the general inventive concepts have been set forth in what are believed to be exemplary illustrative aspects, a wide variety of alternatives will be apparent to those of skill in the art from reading this disclosure. The general inventive concepts are not otherwise limited, except for those instances when presented in specific claims.

EXAMPLES

The following examples are included for the purposes of illustration, and does not limit the scope of the general inventive concepts described herein.

Example 1

The substituted $C_5$ alkyl nitrate additives of formulas (II), (III), and (IV) were evaluated using the CHEMKIN software package for chemical kinetic simulations. A 0-D, closed internal combustion engine reactor (IC-engine) was selected to replace a LTGC research engine, which is based on a standard slider crank compression of a fixed mass. The engine geometry (bore, stroke, and connecting rod length) and the effective compression ratio were imposed in order to reproduce the piston motion during the compression-expansion process. The conditions of the simulations were selected to reproduce a typical operating point of a low-temperature gasoline combustion with additive-mixing fuel injection (LTGC-AMFI) engine at 1200 rpm and are provided in Table 2.

TABLE 2

| | |
|---|---|
| Intake Pressure ($P_{in}$) | 1 bar |
| Intake Temperature ($T_{in}$) | 40° C. |
| Equivalence Ratio ($\phi$) | 0.4 |

The simulations were carried out using PACE-20, a surrogate fuel for a regular E10 gasoline that is representative of U.S. market gasoline fuel, as a base fuel. PACE-20 has been shown to reproduce the main characteristics of regular gasoline, including its octane rating, autoignition reactivity, distillation curve, spray characteristics, sooting tendency, and laminar flame speed. In the simulations, examples were run using PACE-20 doped with 1% by volume of one of the alkyl nitrate additives as provided in Table 3.

TABLE 3

| Sample | Additive |
|---|---|
| Comparative Sample A | 2-ethylhexyl nitrate |
| Comparative Sample B | Pentyl nitrate |
| Sample 1 | 2,4-dimethyl pentyl nitrate |
| Sample 2 | 2-ethyl, 4-methyl pentyl nitrate |
| Sample 3 | 3-methyl pentyl nitrate |

Chemical kinetic sub-mechanisms were designed for each alkyl nitrate based on the decomposition mechanism and reaction rates of EHN chemistry. These sub-mechanisms were integrated in the Co-Optima 2020 detailed chemical kinetic mechanism for gasoline fuel from Lawrence Livermore National Laboratory. The resulting mechanism was used in the simulations. Additional information, including data validating the use of these simulations to approximate the chemical kinetic mechanisms for gasoline fuel, reproduce typical operating points of the LTGC-AMFI engine, and reproduce main characteristics of E10 gasoline, can be found in Lopez Pintor, D. and Dec, J., "Development and Validation of an EHN Mechanism for Fundamental and Applied Chemistry Studies," SAE Technical Paper, 2022-01-0455, 2022, doi:10.4271/2022-01-0455 (published Mar. 29, 2022); Cho, S. and Lopez Pintor, D., "Understanding the effects of doping a regular E10 gasoline with EHN in an HCCI engine: Experimental and numerical study," *Fuel* 329 (2022) 125456, doi:10.1016/j.fuel.2022.125456 (published Aug. 4, 2022); Cho, S., et al., "Chemical kinetic interactions and sensitivity analyses for 2-ethylhexyl nitrate-doped PRF91 using a reduced mechanism," *Fuel* 329 (2022) 125503, doi:10.1016/j.fuel.2022.125503 (published Aug. 6, 2022); and Cheng, S., et al., "Autoignition and preliminary heat release of gasoline surrogates and their blends with ethanol at engine-relevant conditions: Experiments and comprehensive kinetic modeling," *Combustion and Flame* 228 (2021) 57-77, doi:10.1016/j.combustflame.2021.01.033 (published Feb. 26, 2021), the entire contents of each of which are hereby incorporated by reference in their entireties.

FIG. 1 shows the simulated in-cylinder pressure for Comparative Samples A and B and Samples 1-3. In FIG. 1, the curve for Sample 3 overlaps the curve for Sample 2 and Comparative Sample B. The combustion timing is represented by the crank angle for the 50% burn point (CA50). Each of the substituted $C_5$ alkyl nitrate additives included in Samples 1-3 enhanced autoignition reactivity of PACE-20 more than the additive included in Comparative Sample A (EHN), which is a conventional autoignition improving additive. The unsubstituted $C_5$ alkyl nitrate additive included in Comparative Sample B (pentyl nitrate) also enhanced the autoignition reactivity. In particular, the alkyl nitrate additives included in Samples 1-3 enhanced the combustion phasing 2.1 to 2.7 crank angle degrees (CAD) compared to EHN. The CAD generally refers to the position of the crankshaft of the engine during a revolution while the engine is spinning. The higher the autoignition reactivity of the fuel, the lower crank angle degrees at which the fuel will ignite. In FIG. 1, the ignition of the fuel corresponds to the very fast pressure rise event (e.g., where the pressure goes from approximately 45 bar to approximately 80 bar). For EHN, the fuel ignites at approximately 367 CAD, whereas for the other additives, the fuel ignites at lower CAD values (e.g., about 365 CAD), which indicates that the fuel ignites sooner. Accordingly, the results suggest that the substituted $C_5$ alkyl nitrate additives included in Samples 1-3 accelerates the autoignition of the fuel.

Figure 2:
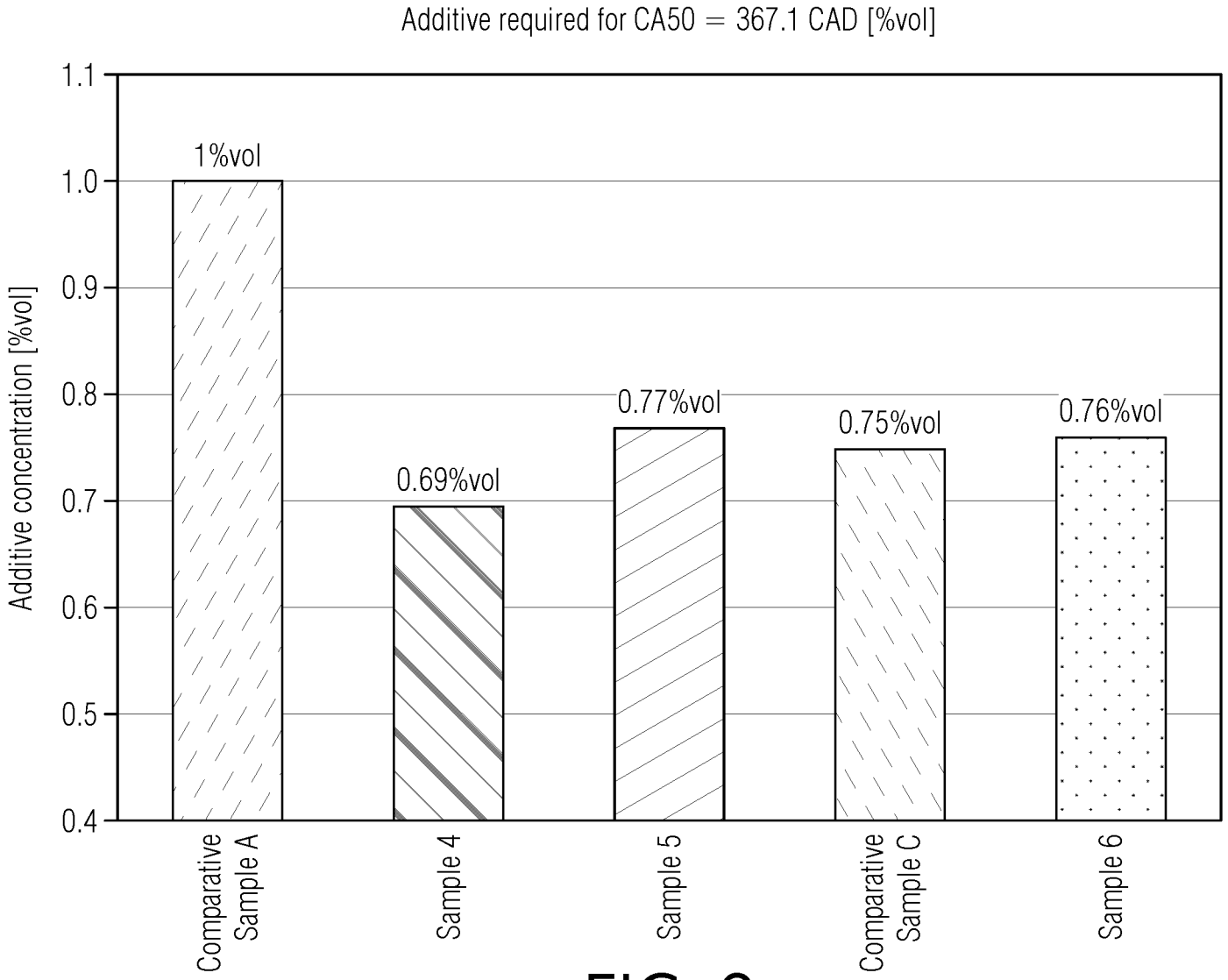
FIG. 2 is a graph showing the estimated additive concentration (% by volume) to achieve the same simulated combustion phasing of Comparative Sample A as shown in FIG. 1.

The concentration the additive of Samples 1-3 and Comparative Sample B was then adjusted in Samples 4-6 and Comparative Sample C, respectively, to match the combustion phasing of Comparative Sample A, and the results are shown in FIG. 2. As shown in FIG. 2, the concentration of alkyl nitrate additives included in Samples 4-6 and Comparative Sample C was reduced by 24%-31%, with 2,4-dimethyl pentyl nitrate (Sample 4) providing the greatest reduction. In particular, Sample 4 included a concentration of 0.69% by volume of 2,4-dimethyl pentyl nitrate and provided the same combustion phasing as 1% by volume of EHN (Comparative Sample A), representing a 31% reduction in additive concentration.

Figure 3:
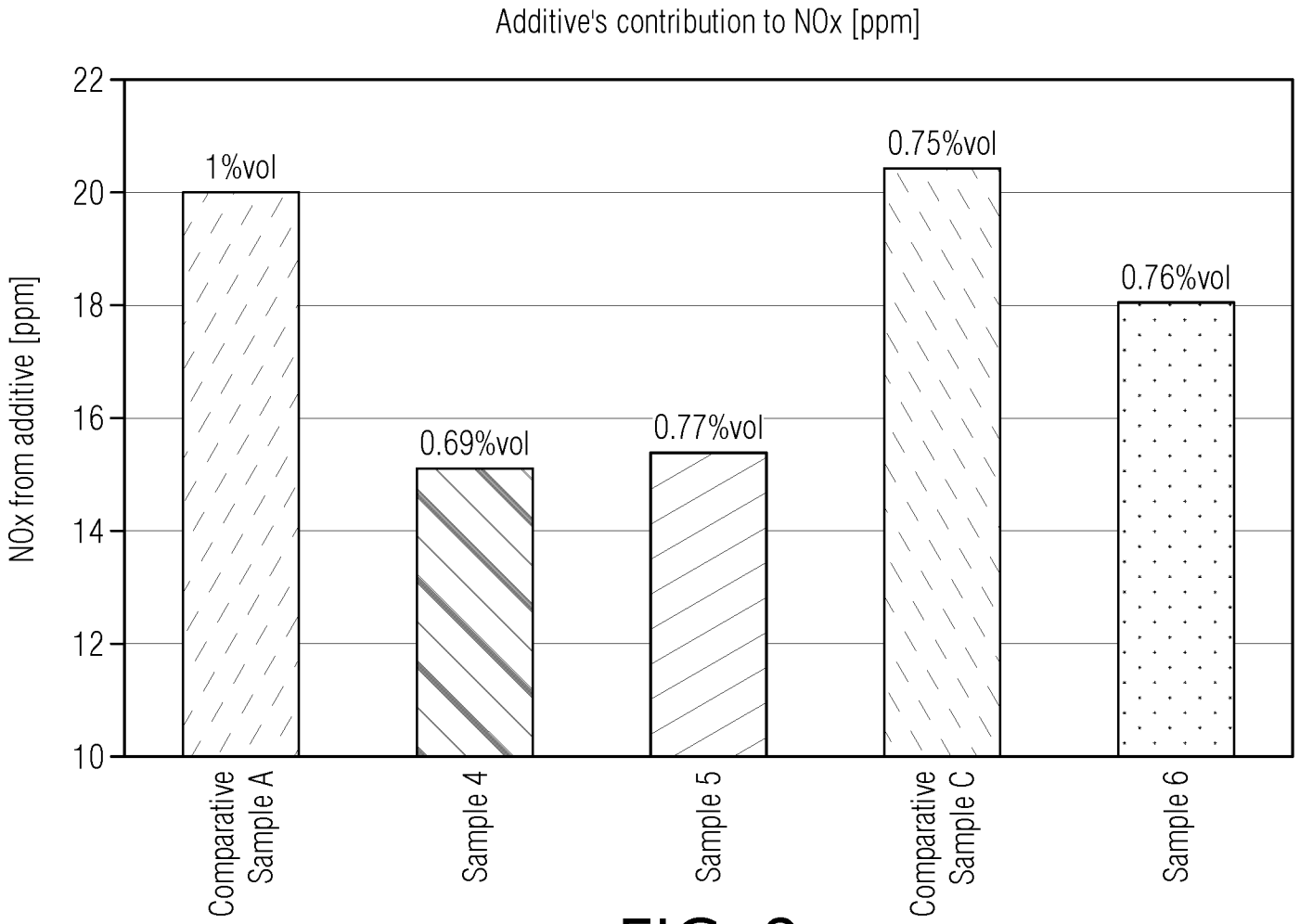
FIG. 3 is a graph showing the estimated NOx emissions attributable to the additive (ppm) for samples including a concentration of alkyl nitrate additive as shown in FIG. 2.

FIG. 3 shows the estimated contribution to engine NOx emissions of the additives compared to Comparative Sample A for Samples 4-6 and Comparative Sample C. As shown in FIG. 3, the substituted $C_5$ alkyl nitrate additives described herein are expected to lead to lower NOx emissions than EHN due to reduced amounts of additive required to ignite the gasoline fuel. As above, Sample 4 gave the greatest reduction in the contribution of the additive to the engine NOx emissions based on simulations. Specifically, the NOx from the additive in Sample 4 was 24.5% less than the NOx from the EHN included in Comparative Sample A for the same combustion phasing. However, Comparative Sample C, which included an unsubstituted $C_5$ alkyl nitrate (e.g., pentyl nitrate) is expected to lead to increased NOx emissions as compared to EHN based on the simulations for the same combustion phasing.

In addition to providing combustion-timing control and eliminating the need for charge heating, another key benefit of working with EHN-doped gasoline is that EHN increases the ϕ-sensitivity of the fuel, which allows greater benefits from fuel stratification techniques for better engine operation and control. The effect of the substituted $C_5$ alkyl nitrate additives on the fuel's ϕ-sensitivity was numerically analyzed following a validated approach described in Lopez-Pintor, D. and Dec, J., "Experimental Evaluation of a Gasoline-like Fuel Blend with High Renewable Content to Simultaneously Increase φ-Sensitivity, RON, and Octane Sensitivity" *Energy Fuels* 2021, 35, 20, 16482-16493, DOI: 10.1021/acs.energyfuels.1c01979 (published Oct. 7, 2021); Lopez Pintor, D., Dec, J., and Gentz, G., "Experimental Evaluation of a Custom Gasoline-Like Blend Designed to Simultaneously Improve ϕ-Sensitivity, RON and Octane Sensitivity," *SAE Int. J. Adv. & Curr. Prac. in Mobility* 2(4):2196-2216, 2020, https://doi.org/10.4271/2020-01-1136 (published Apr. 14, 2020); and Lopez Pintor, D., Dec, J., and Gentz, G., "Φ-Sensitivity for LTGC Engines: Understanding the Fundamentals and Tailoring Fuel Blends to Maximize This Property," SAE Technical Paper, 2019-01-0961, 2019, https://doi.org/10.4271/2019-01-0961 (published Apr. 2, 2019), the entire contents of each of which is incorporated by reference herein in their entireties. The results were compared to those of EHN. The amount of additive used in the simulations was that required to have the same combustion phasing as PACE-20 doped with 1 vol % EHN (FIG. 2). All the substituted $C_5$ alkyl nitrate additives led to virtually the same ϕ-sensitivity, which means that the lower concentration of substituted $C_5$ alkyl nitrate additives compared to EHN does not penalize the ϕ-sensitivity.

Example 2

The ability of the substituted $C_5$ alkyl nitrate additives to enhance the reactivity of diesel fuel was also investigated numerically in CHEMKIN using the same well-validated models as those used to obtain the results with gasoline presented above. A primary reference fuel with a cetane number of 45, which is representative of U.S. on-highway diesel fuel, was used in the simulations. The fuel-temperature distribution of a diesel spray was used to characterize the reactivity of the additized diesel fuel. This fuel-temperature distribution was obtained from the Engine Combustion Network (https://ecn.sandia.gov/) database for Spray A at an ambient pressure of 60 bar and an ambient temperature of 900 K (conditions representative of diesel engine operation).

The ignition delay for each fuel-temperature combination was obtained in a closed, 0-D reactor in CHEMKIN for straight diesel and for diesel doped with EHN and the substituted $C_5$ alkyl nitrate additives. This methodology is graphically described in FIG. 4.

Figure 4:
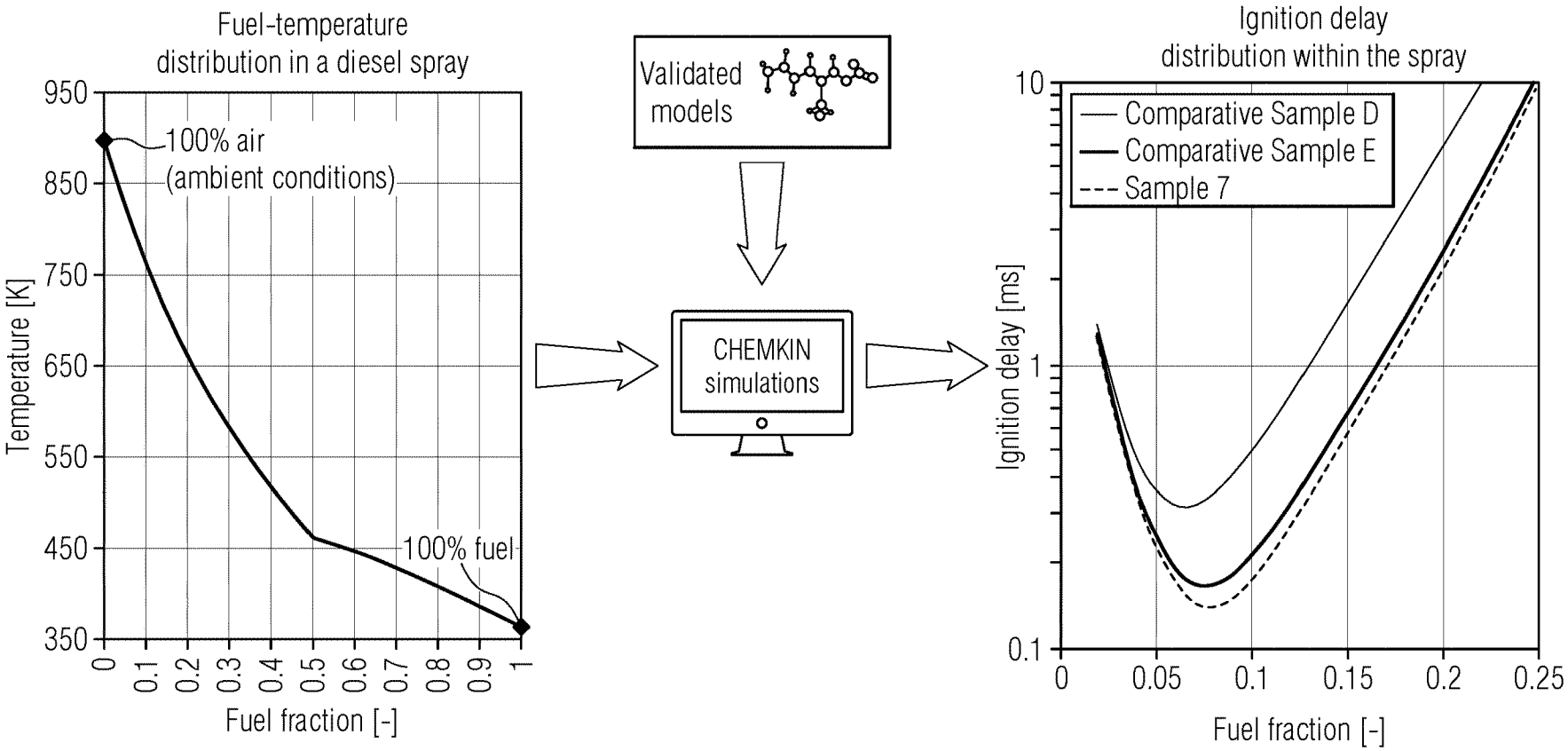
FIG. 4 illustrates the methodology to evaluate the reactivity of a diesel spray as described in Example 2.

The right-hand plot of FIG. 4 shows the ignition delay distribution within a spray of straight diesel fuel (Comparative Sample D), diesel fuel doped with 1% by volume EHN (Comparative Sample E) and diesel fuel doped with 1% volume 2,4-dimethyl pentyl nitrate (Sample 7). Comparative Sample E and Sample 7 show shorter ignition delays than the straight fuel (Comparative Sample D), indicating that the additives increase the reactivity of diesel duel (i.e., its cetane number). Sample 7 shows shorter ignition delays than Comparative Sample E, indicating that the substituted $C_5$ alkyl nitrate additive (i.e., 2,4-dimethyl pentyl nitrate) is a more effective additive than EHN. Similar results were obtained with the other substituted $C_5$ alkyl nitrate additives described above. The most reactive fuel fraction, which is representative of the overall reactivity of the diesel spray, is indicated in FIG. 4.

Figure 5:
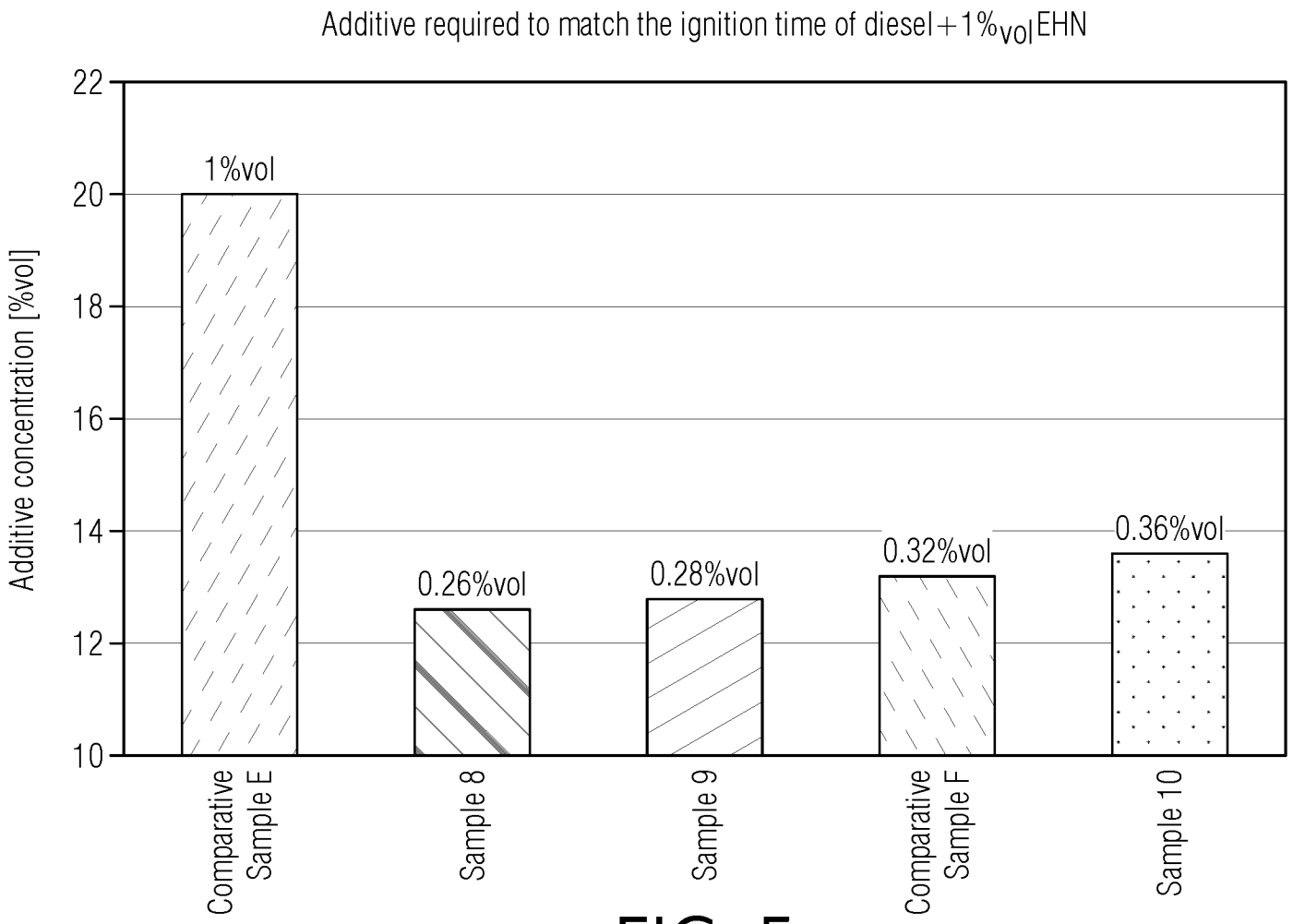
FIG. 5 is a graph showing the estimated additive concentration (% by volume) to achieve the same simulated ignition delay of Comparative Sample E as shown in FIG. 4.

The additive concentration of the substituted $C_5$ alkyl nitrate additives (Samples 8, 9, and 10) and the unsubstituted $C_5$ alkyl nitrate additive described above (Comparative Sample F) was adjusted to match the ignition delay of the most reactive fuel fraction of EHN-doped diesel of Comparative Sample E, and results are shown in FIG. 5. The substituted and unsubstituted $C_5$ alkyl nitrate additives allowed for a reduction in additive concentration of 64%-74%. However, as in the previous example, 2,4-dimethyl pentyl nitrate (Sample 8) gave the highest reduction in additive concentration and 0.26% by volume of 2,4-dimethyl pentyl nitrate led to the same ignition delay as 1% by volume of EHN, which represents a 74% reduction in additive consumption.

In the foregoing description, for purposes of explanation, numerous specific details are set forth in order to provide a thorough understanding of one or more aspects. It may be evident, however, that such aspect(s) may be practiced without these specific details. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Additionally, as used herein, the term "exemplary" is intended to mean serving as an illustration or example of something, and is not intended to indicate a preference.

What has been described above includes examples of one or more aspects. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An additive for a hydrocarbon-based fuel, the additive having a formula of:

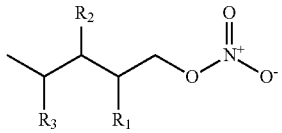

wherein $R_1$, $R_2$, and $R_3$ are each independently selected from —H, —$CH_3$, or —$CH_2CH_3$, wherein at least one of $R_1$, $R_2$, or $R_3$ is not —H, and wherein the additive improves an autoignition reactivity of the hydrocarbon-based fuel.

2. The additive of claim 1, wherein $R_1$ and $R_3$ are —$CH_3$, and $R_2$ is —H.

3. The additive of claim 1, wherein $R_1$ is —$CH_2CH_3$, $R_2$ is —H, and $R_3$ is —$CH_3$.

4. The additive of claim 1, wherein $R_1$ and $R_3$ are —H, and $R_2$ is —$CH_3$.

5. The additive of claim 1, wherein the hydrocarbon-based fuel comprises gasoline.

6. The additive of claim 1, wherein the hydrocarbon-based fuel comprises diesel.

7. A fuel composition comprising:

a hydrocarbon-based fuel; and an additive having a formula of:

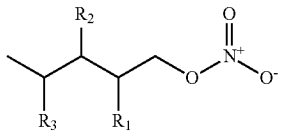

wherein $R_1$, $R_2$, and $R_3$ are each independently selected from —H, —$CH_3$, or —$CH_2CH_3$, and wherein at least one of $R_1$, $R_2$, or $R_3$ is not —H.

8. The fuel composition of claim 7, wherein the additive is present in the fuel composition in an amount of 0.1% by volume to 5% by volume.

9. The fuel composition of claim 7, wherein $R_1$ and $R_3$ are —$CH_3$, and $R_2$ is —H.

10. The fuel composition of claim 7, wherein $R_1$ is —$CH_2CH_3$, $R_2$ is —H, and $R_3$ is —$CH_3$.

11. The fuel composition of claim 7, wherein $R_1$ and $R_3$ are —H, and $R_2$ is —$CH_3$.

12. The fuel composition of claim 7, wherein the hydrocarbon-based fuel comprises gasoline.

13. The fuel composition of claim 7, wherein the hydrocarbon-based fuel comprises diesel.

14. A method of improving the autoignition reactivity of a hydrocarbon-based fuel composition, the method comprising:

mixing an additive with the hydrocarbon-based fuel, the additive having a formula of:

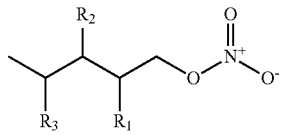

wherein $R_1$, $R_2$, and $R_3$ are each independently selected from —H, —$CH_2CH_3$, or —$CH_3$, and wherein at least one of $R_1$, $R_2$, or $R_3$ is not —H.

15. The method of claim 14, wherein an amount of additive mixed with the hydrocarbon-based fuel is from 0.1% by volume to 5% by volume.

16. The method of claim 14, wherein $R_1$ and $R_3$ are —$CH_3$, and $R_2$ is —H.

17. The method of claim 14, wherein $R_1$ is —$CH_2CH_3$, $R_2$ is —H, and $R_3$ is —$CH_3$.

18. The method of claim 14, wherein $R_1$ and $R_3$ are —H, and $R_2$ is —$CH_3$.

19. The method of claim 14, wherein the hydrocarbon-based fuel comprises gasoline.

20. The method of claim 14, wherein the hydrocarbon-based fuel comprises diesel.

* * * * *